US009957860B2

(12) United States Patent
Reichelt et al.

(10) Patent No.: US 9,957,860 B2
(45) Date of Patent: May 1, 2018

(54) OIL SEPARATOR FOR CRANKCASE VENTILATION OF AN INTERNAL COMBUSTION ENGINE

(71) Applicant: THYSSENKRUPP PRESTA TECCENTER AG, Eschen (LI)

(72) Inventors: Robert Reichelt, Frankenberg/Sachsen (DE); Ulf Müller, Chemnitz (DE); Jürgen Meusel, Dittmannsdorf (DE)

(73) Assignee: THYSSENKRUPP PRESTA TECCENTER AG, Eschen (LI)

( * ) Notice: Subject to any disclaimer, the term of this patent is extended or adjusted under 35 U.S.C. 154(b) by 0 days. days.

(21) Appl. No.: 14/898,362

(22) PCT Filed: Jun. 17, 2014

(86) PCT No.: PCT/EP2014/001645
§ 371 (c)(1),
(2) Date: Dec. 14, 2015

(87) PCT Pub. No.: WO2014/202209
PCT Pub. Date: Dec. 24, 2014

(65) Prior Publication Data

US 2016/0138446 A1 May 19, 2016

(30) Foreign Application Priority Data

Jun. 18, 2013 (DE) ..... 10 2013 106 334

(51) Int. Cl.
*F01M 13/04* (2006.01)
*F01L 1/047* (2006.01)

(52) U.S. Cl.
CPC ..... *F01M 13/04* (2013.01); *F01L 1/047* (2013.01); *F01L 2001/0475* (2013.01); *F01M 2013/0422* (2013.01); *F01M 2013/0433* (2013.01)

(58) Field of Classification Search
CPC ..... F01M 13/04; F01M 2013/0422; F01M 2013/0433; F01M 2013/0427; F01M 2013/0461; F01M 2013/0438
See application file for complete search history.

(56) References Cited

U.S. PATENT DOCUMENTS 3,641,745 A 2/1972 Moore
3,915,679 A 10/1975 Roach et al.
(Continued)

FOREIGN PATENT DOCUMENTS

DE 10 2004 011 177 A1 10/2005
DE 10 2008 044 857 A1 8/2010
(Continued)

OTHER PUBLICATIONS

German Language International Search Report for International patent application No. PCT/EP2014/001645; dated Sep. 12, 2014.
(Continued)

*Primary Examiner* — Jacob Amick
(74) *Attorney, Agent, or Firm* — thyssenkrupp North America, Inc.

(57) ABSTRACT

An oil separator may be used in a variety of contexts, one of which is for crankcase ventilation of an internal combustion engine. The oil separator may include a hollow member that extends along a longitudinal axis and is configured to receive a gas flow that is charged with oil. The oil separator may also include an oil separation member disposed within the hollow member and against which the gas flow flows. A redirection member may be disposed proximate the oil separation member in the hollow member, wherein the redirection member redirects at least a portion of the gas flow traveling substantially along the longitudinal axis radially outwards so as to impact an inner side of the oil separation member. As a result of an impactor effect from the gas flow striking the oil separation member as well as the
(Continued)

inertia of the oil, the oil may remain in and/or pass through the oil separation member.

15 Claims, 7 Drawing Sheets

(56) References Cited

U.S. PATENT DOCUMENTS

| | | | | |
|---|---|---|---|---|
| 2003/0075046 | A1* | 4/2003 | Lenzing | B01D 45/06 95/267 |
| 2004/0144374 | A1* | 7/2004 | Knollmayr | F01M 13/04 123/572 |
| 2008/0264018 | A1* | 10/2008 | Herman | B01D 45/08 55/462 |
| 2012/0031276 | A1* | 2/2012 | Meusel | F01L 1/047 96/400 |

FOREIGN PATENT DOCUMENTS

| | | | | |
|---|---|---|---|---|
| DE | 102008044857 | A1 * | 8/2010 | B01D 45/08 |
| DE | 10 2009 012 400 | A1 | 9/2010 | |
| DE | 102009019643 | A1 | 11/2010 | |
| DE | 10 2010 015 838 | A1 | 10/2011 | |
| DE | 202012002218 | U1 | 3/2013 | |
| EP | 2 597 277 | A1 | 5/2003 | |
| GB | 1582968 | A | 1/1981 | |
| JP | S53-32477 | A | 3/1978 | |
| JP | S60 173 614 | U | 11/1985 | |
| JP | 2001-212410 | A | 8/2001 | |

OTHER PUBLICATIONS

English translation of International Search Report for International patent application No. PCT/EP2014/001645; dated Sep. 12, 2014.
English translation of the abstract of EP 2 597 277 A1.
English translation of the abstract of DE 10 2008 044 857 A1.
English translation of the abstract of DE 10 2010 015 838 A1.
English translation of the abstract of DE 10 2004 011 177 A1.
English language Abstract for DE 102009019643 A1 listed above.
English language Abstract for DE 202012002218 U1 listed above.
First Japanese Office Action issued in JP2016-520310, dated Feb. 6, 2018.

* cited by examiner

OIL SEPARATOR FOR CRANKCASE VENTILATION OF AN INTERNAL COMBUSTION ENGINE

CROSS REFERENCE TO RELATED APPLICATIONS

This application is a U.S. National Stage Entry of International Patent Application Serial Number PCT/EP2014/001645, filed Jun. 17, 2014, which claims priority to German Patent Application No. DE 102013106334.9 filed Jun. 18, 2013, the entire contents of both of which are incorporated herein by reference.

FIELD

The present disclosure relates to oil-separating devices and, more particularly, to the ventilation of crankcases of internal combustion engines.

BACKGROUND

In internal combustion engines and piston compressors, there are in practice observed leakage losses which may be attributed to an incomplete sealing, for example, of the piston/cylinder path or the valve guides in the cylinder head. The leakage losses are referred to as blowby gas and contain a substantial proportion of oil. With respect to internal combustion engines, it is therefore conventional to direct the blowby gas which occurs during operation of the internal combustion engine back into the intake tract of the internal combustion engine. In order, on the one hand, to minimize the oil loss as a result of the blowby gas and, on the other hand, to ensure optimum combustion and minimal environmental damage, it is known to supply the blowby gas to an oil separator and to direct the separated oil back into the oil circuit. In this instance, it is sought to configure corresponding oil separation systems to be as simple as possible but nevertheless to be reliable and efficient. Another aspect for improving oil separators relates to a minimal flow resistance to which the gas flow is subjected when the oil separator is flowed through. However, a high separation capacity is necessary in order to minimize the output of residual oil in the charge air tract, in particular in order to prevent air mass measuring members and turbochargers from becoming fouled by oil.

DE 10 2009 012 400 A1 sets out an oil separator which is suitable for crankcase ventilation of an internal combustion engine. The oil separator has as the housing a hollow member which can be formed, for example, by a portion of a camshaft or the hollow member is constructed to be tubular and is integrated in a cylinder head cover of an internal combustion engine. A torsion generator is arranged in the hollow member and the hollow member has an end-side supply opening for introducing the gas flow and a discharge opening for discharging the gas flow. The gas flow introduced into the hollow member may also guide oil in the form of oil mist or spray droplets which are intended to be removed from the gas flow by the oil separator. To this end, the hollow space further has a discharge opening which is for discharging separated oil and which is constructed separately from the discharge of the gas flow which has been purged of oil.

The oil separator set out uses a torsion effect which can be used in a particularly advantageous manner when the oil separator is formed in a rotating camshaft which forms the hollow member of the oil separator. To this end, there is provided in the hollow member a torsion generator which has a plurality of helical flow channels and through which a torsion is introduced into the gas flow which is charged with oil. As a result of the associated change in the flow direction of the gas flow, oil droplets which are also carried in the gas flow are separated on the inner wall of the hollow member and, as a result of the throughflow of the hollow member in the longitudinal direction, the oil droplets reach the outer region of the oil separation ring, by which the gas flow is separated in the central region of the hollow member from the oil flow in the wall region of the hollow member. Finally, after the oil separation ring has been arranged, the oil can be separated by the discharge opening for the oil from the discharge opening of the cleaned gas flow which is subsequently supplied to the discharge tract of the internal combustion engine or, for example, a piston compressor. In order to form the oil separation ring, it is set out that it can be constructed from a porous plastics material or a sintered material, wherein plastics or metal braided material can also be advantageously used. Such braided materials form a large number of hollow spaces and labyrinth-like formations, whereby the separation of the oil from the gas flow is further promoted. As a result of the torsion, the oil droplets are conveyed radially outward in relation to the longitudinal axis of the hollow member and the gas flow is guided through the central passage in the oil separation ring.

As a result of the rotational movement which is introduced into the gas flow by the torsion generator, there is produced during flow through the oil separator a substantial flow resistance in the gas flow, by which the separation power is again reduced by lower flow rates through the oil separator.

SUMMARY

An object of the invention is to develop an oil separator, in particular for the crankcase ventilation of an internal combustion engine, which allows a high separation power of oil from a gas flow and which is particularly developed in that a flow resistance of the gas flow which is as small as possible is produced as a result of the hollow member.

This object is achieved on the basis of an oil separator in accordance with the preamble of claim 1 in conjunction with the characterizing features. Advantageous developments of the invention are set out in the dependent claims.

The invention includes the technical teaching that, in the region of the passage of the oil separation member, there is formed in the hollow member a redirection member which can be flowed against with the gas flow by the gas flow substantially from the direction of the longitudinal axis and by which the gas flow can be redirected radially outward against the inner side of the oil separation member.

The invention is based on the notion of directing the gas flow which is charged with oil at the inner side against the oil separator which is formed, for example, to be tubular or sleeve-like. The oil from the gas flow can be separated from the gas flow with the oil separator and the gas flow can in a state purged of oil flow through the oil separator through the, for example, central axial passage, wherein the separated oil can be discharged between the outer side of the oil separation member and the inner wall of the tubular member. Consequently, the oil separation member forms, in the continuing path of the gas flow, a barrier between the separated oil and the gas flow, wherein the oil can be discharged from the hollow member after passing through the oil separation member and can be supplied to the oil circuit of the internal combustion engine again. The cleaned gas flow can be directed out of the hollow member and supplied to the charge air tract of the internal combustion engine.

The oil separation member can extend in a substantially rotationally symmetrical manner about the longitudinal axis of the hollow member and the oil separation member may be formed in the hollow member in such a manner that substantially the entire gas flow passes through the passage in the oil separation member. The redirection member can advantageously be formed centrally in the passage of the oil separation member and it can also extend in a rotationally symmetrical manner about the longitudinal axis. In this instance, it is particularly advantageous for the redirection member to be located in the rear third of the oil separation member when viewed in the downstream direction, that is to say, located in the direction of flow, whereby the gas flow is redirected in such a manner that it is directed substantially over the entire length of the oil separation member against the inner side thereof. In this instance, the redirection member can comprise an outer diameter which is determined so that the purged gas flow can flow between the inner diameter of the oil separation member and the outer diameter of the redirection member with low pressure loss. The indication of the arrangement or orientation formed in a downstream direction reproduces in accordance with the present invention only a directional indication which describes a direction which is orientated in or with a possible gas flow direction.

In a particularly advantageous manner, the redirection member and in particular the oil separation member may be constructed in a rotationally symmetrical manner, wherein the redirection member may have a flow tip which is located in the longitudinal axis and which has a redirection contour which increases downstream, preferably in a hyperbola-like manner. As a result of the hyperbola-like redirection contour, there is produced a rotational member which forms a peripheral flow channel so that the redirection of the flow is carried out comparatively slowly in order to prevent the oil which is carried in the gas flow from already becoming separated on the surface of the redirection member. The redirection of the gas flow by the redirection member against the inner side of the oil separation member is carried out in such a manner that the gas flow acts on the inner side of the oil separation member substantially vertically in order to achieve a particular impactor effect. As a result of the impactor effect, there is brought about a powerful subsequent redirection of the gas flow which the mass-charged droplets of oil cannot follow, and are taken up by the oil separation member. The oil in the gas flow may be present in the form of oil mist or oil droplets which can travel through the oil separation member in order to finally guide it further at the outer side of the oil separation member between the oil separation member and the inner side of the hollow member downstream in a state separated from the purged gas flow.

It is particularly advantageous for the oil separation member to be formed in an elongate manner in the direction of the longitudinal axis and in particular in a funnel-like manner, wherein the funnel-like shape is orientated so as to be open counter to the flow direction of the gas flow. It is thereby brought about that the gas flow does not have to be redirected by the redirection member, for example, by 90°, as would be necessary in order to allow the gas flow to strike substantially perpendicularly the inner side of a hollow-cylindrical member. As a result of the funnel-like shape, it is instead possible for the redirection of the gas flow to have to be produced, for example, substantially only through from 45° to 60°, in order already to strike substantially perpendicularly the inner side of the funnel-like oil separation member and in order to obtain a corresponding impactor effect.

For structural reasons, it is further advantageous for the redirection member to be received in the region of the passage of the oil separation member in a retaining manner by a retention member, wherein radial gaps through which the gas flow can flow for the redirection thereof can be formed in the retention member. The radial gaps may already be separated from each other by fan-like plates which already bring about, in addition to the redirection member, upstream of the redirection member a redirection of the gas flow in the direction toward the inner side of the oil separation member. The redirection of the gas flow is carried out in principle so as to apply a radial flow component which is superimposed on the axial flow component of the gas flow in the direction of the longitudinal axis of the hollow member. The retention member thereby forms a type of basket which comprises openings in order to form the radial gaps, and the basket-like retention member opens in the redirection member, wherein the redirection member and the retention member may be constructed so as to be integral, for example, from a plastics component.

In a further advantageous manner, there may be provision for there to be arranged, upstream of the passage of the oil separation member, an inlet funnel, by which the gas flow can be accelerated into the passage of the oil separation member. As a result of the arrangement of the inlet funnel, it is particularly possible for the gas flow charged with oil not to already strike the oil separation member at the end side. As a result of the inlet funnel, the gas flow is pre-accelerated in order to already have a higher speed before redirection by the redirection member and by the radial gaps in the retention member. Subsequently, the gas flow can be further accelerated because another flow constriction is produced by the radial gaps against the inner side of the oil separation member.

In order to advantageously influence the behavior of the gas flow after passing through the oil separation member, there may be formed in the hollow member downstream of the oil separation member an opening funnel which forms a diffuser. The opening funnel is open in the downstream direction, that is to say, the opening funnel has a greater inner diameter with increasing distance from the oil separation member, and can increase up to the inner diameter of the hollow member. The arrangement of the diffuser downstream of the oil separation member may result in a further decrease of the pressure loss of the gas flow in the opening funnel, whereby the flow resistance of the gas flow is further reduced when the flow passes through the oil separator. The inlet funnel for accelerating the gas flow may merge into the retention member with the radial gaps, for example, in an integral manner, wherein at the side of the oil separation member the opening funnel can abut it. In this instance, the smallest diameter of the opening funnel may substantially correspond to the smallest diameter of the funnel-like oil separation member. The inlet funnel can project into the funnel-like oil separation member at least in the transition to the retention member, wherein the redirection member can be arranged in the region and in particular shortly before the region of the smallest cross-section of flow which is formed by the transition of the oil separation member to the opening funnel.

The oil separation member may be formed at least partially from a nonwoven material. Other materials for forming the oil separation member may be porous plastics materials or sintered materials, wherein braided materials comprising plastics material or metal can advantageously be used. In particular, the oil separation member may be formed from a material which is not contaminated by the introduction of oil and other particulates, in particular impurities, and the oil can pass through the material of the oil separation member in order, for example, to leave the oil separation member again at the side remote from flow.

According to another advantageous aspect of the present invention, the oil separation member and in particular the nonwoven material may have a gas-permeability which is determined in such a manner that the gas flow flows partially through the oil separation member. In particular when the gas flow which is guided by the oil separator becomes more powerful, both an impactor effect and a filter effect can be achieved by the oil separation member if at least a portion of the gas flow passes through the oil separation member. Consequently, a first portion can be redirected at the inner side of the oil separation member using an impactor effect in order finally to leave the oil separation member through the passage thereof. Another portion of the gas flow can pass through the material of the oil separation member and be further conveyed with the separated oil at the outer side of the opening funnel, in particular in the radial gap between the opening funnel and the inner side of the hollow member. The radial gap which is formed between the outer side of the opening funnel and the inner side of the hollow member allows guiding of the gas flow so that the oil is separated from the gas flow by the increased wall contact in order also to obtain a cleaning effect. In particular after the gas has passed through the oil separation member, the oil is in droplet form and can travel along the outer side of the opening funnel or along the inner side of the hollow member in order finally to be supplied to a separation opening.

In a particularly advantageous manner, the hollow member can be formed by at least one portion of a camshaft of an internal combustion engine or the hollow member is constructed to be an integral component of a cylinder head cover of an internal combustion engine. Particularly when the hollow member forms a portion of a camshaft, it rotates during operation of the internal combustion engine so that the redirection of the gas flow radially outward is supported by the rotation of the hollow member. The redirection member, the retention member, the inlet funnel and the opening funnel and in particular the oil separation member can also rotate with the hollow member so that a torsion which supports outward displacement of the oil is formed in the gas flow. Consequently, by the oil separation member being subjected to flow, the oil is guided in an increased manner against the inner side of the oil separation member so that the redirection of the gas flow by the redirection member with the rotation of the hollow member allows an increasing effect for separating the oil at the oil separation member.

As a result of the embodiment of the oil separator according to the invention, a very small pressure loss of the gas flow during flow through the oil separator is achieved. In particular, very narrow cross-sections of flow are prevented, as used in nozzle openings for flowing against an oil separator. The cross-sections of flow for the gas flow to flow through are simply reduced slightly and, as a result of the flow contour of the redirection member in the manner of a half rotational hyperboloid, there is produced a gentle redirection of the gas flow against the inner side of the funnel-like oil separation member without significant pressure losses thereby being produced.

According to another embodiment, a disc-like oil separation ring may be located upstream of the elongate oil separation member, wherein, according to still another embodiment, a flow guiding member having a flow contour which increases downstream can be located upstream of the disc-like oil separation ring. It is thereby possible for the oil separator to have two oil separation members which comprise, for example, a nonwoven material, and which can be flowed through one after the other in the flow path of the gas flow. The oil separation ring can be acted on with a weak gas flow, for example, only at the surface, as can the downstream main oil separation member, so that the gas flow does not completely flow through the nonwoven material. The gas flow passes the oil separation ring through a center opening. If the gas flow is more powerful, it can flow through the oil separation ring. The oil can be separated from the gas flow in both variants so that the oil runs off in droplet form at the inner side on the hollow member.

According to another variant, the redirection member does not have to be constructed in a rotationally symmetrical manner and it may also be constructed so as to be elongate in a transverse direction. In particular, the oil separation member does not have to be constructed in a rotationally symmetrical manner and it can also have a planar extent which is elongate in a transverse direction. The redirection member may have alternatively to a flow tip a flow edge which is located in the transverse direction. Consequently, the oil separation member is elongate in the direction of the longitudinal axis and is formed in particular in a funnel-like manner, wherein the funnel-like shape is constructed to be open counter to the flow direction of the gas flow.

According to still another variant, the tubular oil separation member may again be constructed from a nonwoven material and may be located with a substantially constant outer diameter in a first portion of the hollow member which has a smaller diameter so that no gap or only a very small radially extending gap is present between the oil separation member and the inner side of the hollow member. As a result, the inner side of the hollow member forms an impact face for a gas flow which travels through the oil separation member and for oil present therein at least in the front region at the flow side.

In this instance, the hollow member may be constructed downstream so as to have a second portion having a greater diameter or having at least one lateral expansion so that the inner side of the hollow member does not adjoin the outer side of the oil separation member and does not form an impact face, whereby throughflow of the oil separation member with the gas flow can be improved in this partial region.

The variants of the oil separator set out above are constructed in such a manner that the gas flow is redirected only radially outward or partially also inward again without a torsion or a flow component which would be directed about the longitudinal axis of the oil separator being introduced into the gas flow. The advantage is thereby afforded that the gas flow is subjected during flow through the oil separator to a smaller pressure decrease than in the case of introduction of a torsion in the gas flow, as known from the prior art. The torsion-free guiding of the gas flow through the oil separator is particularly based on the construction of the redirection member as a rotation member or as a member which is planar in a transverse direction and which limits the redirection of the gas flow to radial and axial flow components.

DETAILED DESCRIPTION

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

Figure 1:
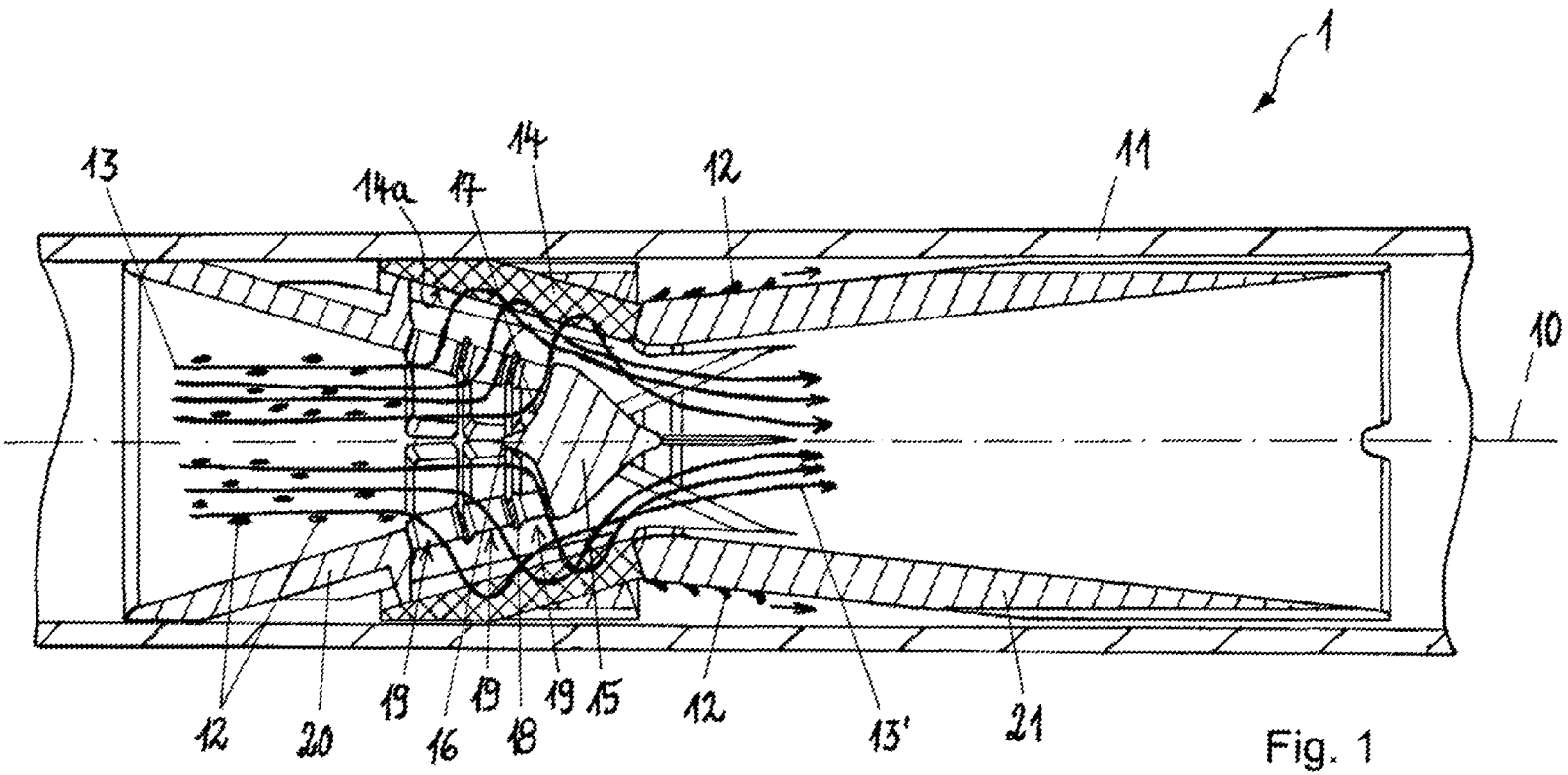
FIG. 1 is a sectional view of an example oil separator, wherein a weakly formed gas flow is shown to be passing through the example oil separator.
Figure 2:
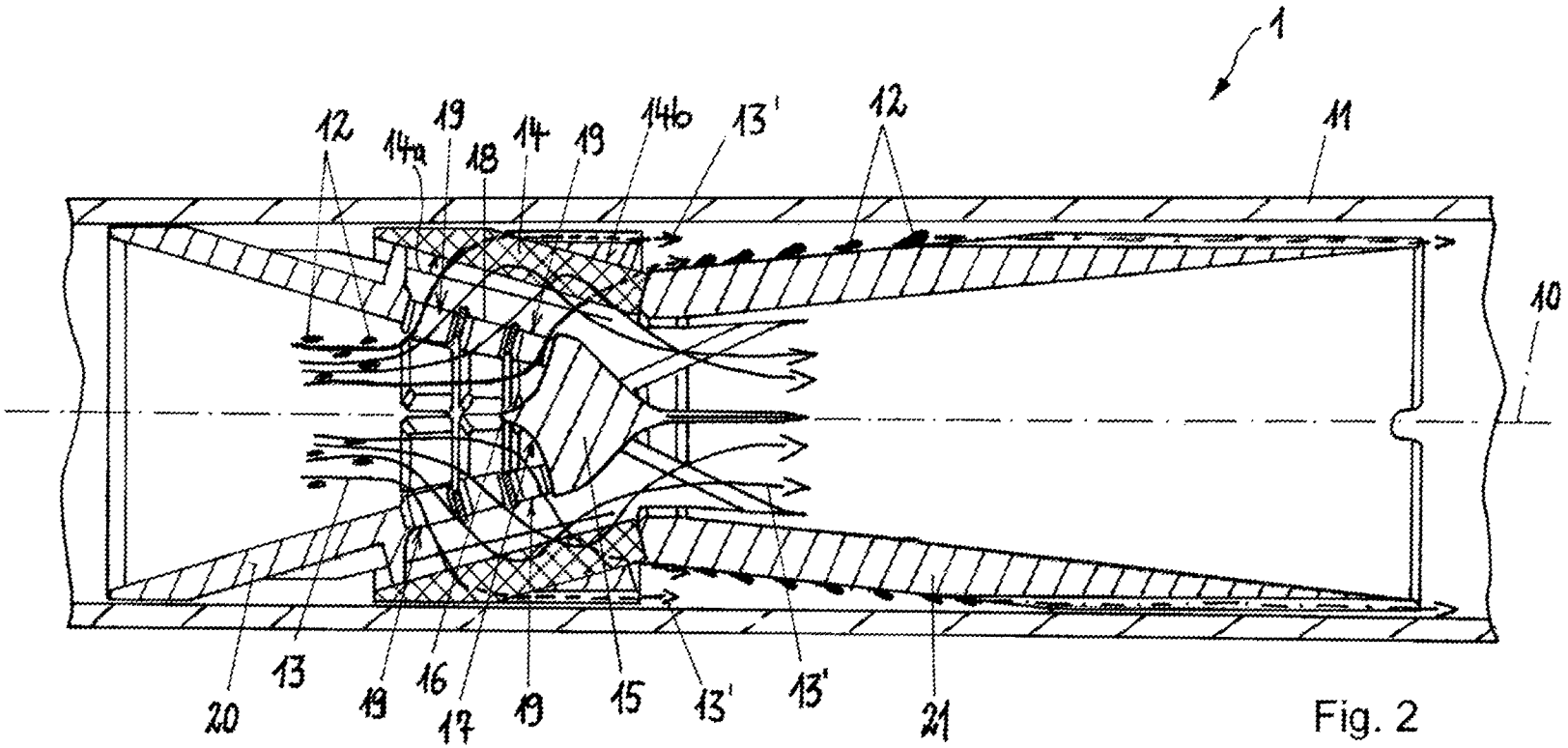
FIG. 2 is a sectional view of an example oil separator, wherein a powerfully formed gas flow is shown to be passing through the example oil separator.

FIGS. 1 and 2 are respective cross-sections of an oil separator 1 having the features of the present invention. The oil separator 1 has a hollow member 11 which extends along a longitudinal axis 10. The hollow member 11 can, for example, be formed by a portion of a camshaft which as a tubular carrier shaft forms the hollow member 11. According to an alternative embodiment, the hollow member 11 may be integrated in a cylinder head cover of an internal combustion engine. In this instance, the hollow member 11 according to the embodiment shown is constructed to be rotationally symmetrical about the longitudinal axis.

At a first side, a gas flow 13 which is charged with oil 12 can be introduced into the hollow member 11 and there is located at the side of the gas introduction an inlet funnel 20 which extends as far as the inner side of the hollow member 11. Thus, the gas flow 13 is completely introduced into the inlet funnel 20, whereby the gas flow 13 accelerates in the direction toward the longitudinal axis 10. A retention member 18 adjoins the inlet funnel 20 and a redirection member 15 is located downstream of the retention member 18 and has a flow tip 16 which is directed counter to the flow direction of the gas flow 13 and which is located in the longitudinal axis 10. In this instance, the redirection member 15 extends in a rotationally symmetrical manner about the longitudinal axis 10 and there adjoins the flow tip 16 a redirection contour 17 which has in a downstream direction an increasing diameter, wherein the increase of the diameter forms, for example, a hyperbola-like redirection contour 17. The gas flow 13 which is accelerated by the inlet funnel 20 strikes the redirection member 15 with the redirection contour 17 and is radially redirected outward.

Furthermore, an oil separation member 14 which is constructed in a funnel-like manner is located in the hollow member 11 and the funnel-like shape opens counter to the direction of the gas flow 13. The oil separation member 14 is located in this instance in the longitudinal axis 10 in such an axial position that the redirection member 15 is located approximately in the rear third in the oil separation member 14. In an upstream direction, the retention member 18 which is constructed with radial gaps 19 adjoins the redirection member 15. The gas flow 13 which strikes the redirection member 15 is guided through the radial gaps 19 of the retention member 18 by the radially outwardly directed redirection by the redirection contour 17 and, as a result of the radial redirection of the gas flow 13, it strikes the inner side 14*a* of the oil separation member 14 which is formed from a nonwoven material.

A peripheral radial gap extends between the retention member 18 and the inner side 14*a* of the oil separation member 14 so that the gas flow 13 can flow round the redirection member 15 and can continue to flow downstream through the central passage through the oil separation member 14.

An opening funnel 21 which acts as a diffuser and by which the pressure loss is minimized during flow through the oil separator 1 with the gas flow 13 adjoins the oil separation member 14. After a passage of the gas flow 13 through the retention member 18, after the redirection member 15 is flowed round and after striking the inner side 14*a* of the oil separation member 14, the gas flow 13 is purged of the oil 12 during the continuing travel through the opening funnel 21 so that the cleaned gas flow 13' can be supplied to the air intake tract of the internal combustion engine. The separated oil 12 can subsequently be supplied again to the oil circuit of the internal combustion engine via separation openings (not shown) in the hollow member 11.

The views of FIGS. 1 and 2 show a separation of the oil 12 by the oil separation member 14 in such a manner that the oil 12 is discharged in the radial gap between the outer side of the opening funnel 21 and the inner side of the hollow member 11. The separation of the oil 12 from a more weakly formed gas flow 13 is described below in connection with FIG. 1 and the separation of the oil 12 from a more powerfully formed gas flow 13 is described below in connection with FIG. 2. The oil 12 is shown by way of example in droplet form which is conveyed with the gas flow 13 and the oil 12 may in the same manner be present in the form of oil mist or spray oil. In addition to the oil 12, foreign bodies in particulate form which can also be separated by the oil separator 1 from the gas flow 13 may be present in the gas flow 13.

FIG. 1 shows a throughflow of the oil separator 1 with a more weakly formed gas flow 13 which is charged with oil 12. The gas flow 13 is accelerated by the inlet funnel 20 and is redirected by the redirection member 15 in such a manner that the gas flow 13 passes through the radial gaps 19 in the retention member 18. Subsequently, the gas flow 13 strikes the inner side 14*a* of the oil separation member 14, whereby an impactor effect is achieved. As a result of the impactor effect, the gas flow 13 is powerfully redirected, wherein the oil 12 remains in the oil separation member 14 as a result of the inertia of the oil 12, passes through the oil separation member 14 and is discharged at the outer side of the oil separation member 14, for example, shown with oil 12 in droplet form which runs along the outer side of the opening funnel 21. That embodiment therefore shows an effect of the oil separation member 14 as an impactor so that the gas flow 13 substantially completely passes the central passage of the oil separation member 14 and is introduced into the opening funnel 21.

FIG. 2 shows the oil separator 1 having a more powerfully formed gas flow 13 which in a state charged with oil 12 is introduced into the inlet funnel 20. The gas flow 13 is redirected by the redirection member 15 through the radial gaps 19 in the retention member 18 against the inner side 14*a* of the oil separation member 14 and, as a result of the more powerful formation of the gas flow 13, a portion of the gas flow 13 is subjected to an impactor effect and is simply redirected at the inner side 14*a* of the oil separation member 14, which is accompanied by a separation of the droplet-like oil 12. An additional portion of the gas flow 13 flows through the oil separation member 14 and is discharged again together with the oil 12 at the outer side 14*b* of the oil separation member 14. The portion of the gas flow 13 flowing through the oil separation member 14 extends between the inner wall of the hollow member 11 and the outer side of the opening funnel 21 in a downstream direction, wherein a separation of the gas flow 13' from the oil 12 is also maintained in the outer region of the opening funnel. Subsequently, that cleaned gas flow 13' can be re-combined outside the opening funnel 21 with the cleaned gas flow 13' within the opening funnel 21. The oil 12 can be discharged from the hollow member 11 in a manner not shown in greater detail by separation openings and supplied to the oil circuit of the internal combustion engine again. The cleaned gas flow 13' can be supplied to the charge air tract of the internal combustion engine.

Figure 3:
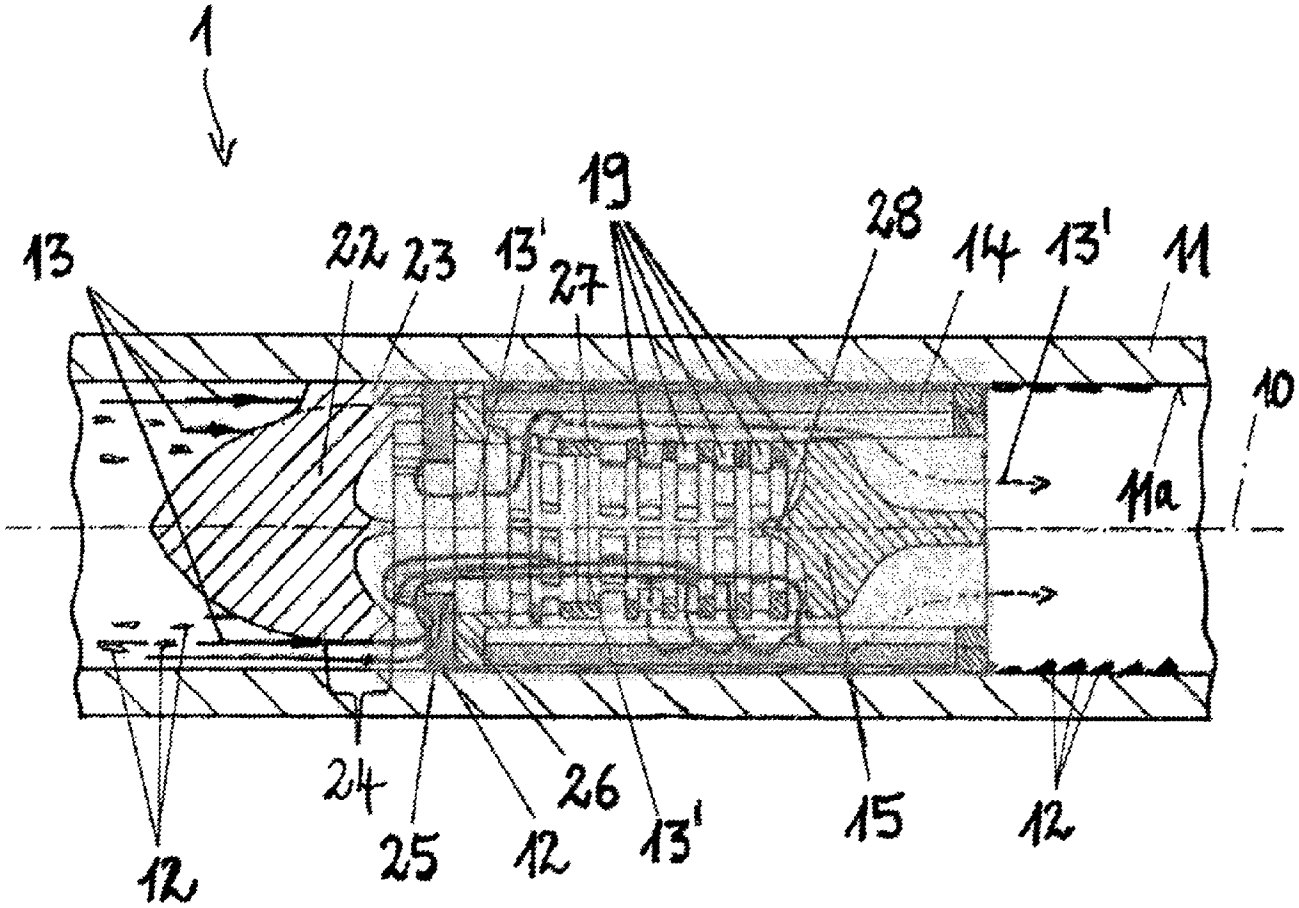
FIG. 3 is a sectional view of an example oil separator that includes an example oil separation ring arranged upstream of an example oil separation member, as well as an example flow guiding member having a flow contour that increases in a downstream direction.

FIG. 3 shows another embodiment of an oil separator 1 which is formed in a hollow member 11. The oil separator 1 has a flow guiding member 22 which is flowed against by a gas flow 13 and which is charged with droplets of oil 12. The flow guiding member 22 extends in a rotationally symmetrical manner about the longitudinal axis 10 of the hollow member 11 and is retained against the inner side 11*a* of the hollow member 11 by means of corresponding retention ribs 23, of which one retention rib 23 is illustrated as a cross-section at the upper side.

A flow cross-section region 24 which is formed substantially over the entire periphery around the flow guiding member 22, irrespective of the retention ribs 23, is formed between the outer side of the flow guiding member 22 and the inner side 11*a* of the hollow member 11. The gas flow 13 is accelerated by the flow guiding member 22 into the flow cross-section region 24 and the accelerated gas flow 13 subsequently strikes an oil separation ring 25 which is connected upstream of a subsequent additional oil separation member 14. The oil separation ring 25 has a rear-side carrier ring 26, against which the oil separation ring 25 is supported, wherein the oil separation ring 25 is formed from a nonwoven material and forms a first separation stage.

As a result of the gas flow 13 striking the oil separation ring 25 comprising nonwoven material, there is produced an impactor effect so that droplets of the oil 12 are already separated by the impactor effect at the oil separation ring 25. The separated oil 12 can travel along the inner side 11*a* in a downstream direction through corresponding recesses between the carrier ring 26 and the inner side 11*a* of the hollow member 11 in order subsequently to reach a separation opening (not shown) in order to direct the oil 12 out of the hollow member 11.

The gas flow 13' redirected by the impactor effect passes through the oil separation member 14 through an inner passage, wherein the gas flow 13' is already pre-cleaned. The pre-cleaned gas flow 13 is subsequently brought via an intermediate element 27 into operational influence with the redirection member 15 and the gas flow 13' is redirected by the redirection member 15 against the oil separation member 14. The intermediate element 27 has radial gaps 19, through which the gas flow 13' reaches the inner side of the additional oil separation member 14 which is formed in a tubular or sleeve-like manner. The redirection of the gas flow 13' radially outward is brought about by the redirection member 15 which has at the front side a redirection tip 28 and the redirection tip 28 is followed by a substantially hyperbola-like member shape of the redirection member 15 which extends in a rotationally symmetrical manner about the longitudinal axis 10 and which is formed in an integral manner with the intermediate element 27.

The gas flow 13' which reaches the inner side of the oil separation member 14 is subjected to an additional impactor effect, whereby an additional separation effect of droplet-like oil 12 is achieved so that finally the gas flow 13' which is discharged from the oil separator 1 at the right-hand side is cleaned in a particular manner.

The additional oil separation member 14 may also comprise a nonwoven material and the pre-cleaned gas flow 13 can simply flow against the inner side of the oil separation member 14 or even also flow through the oil separation member 14 at least with a partial gas flow. The separated oil 12 can subsequently be discharged via an oil discharge opening which is not shown.

Figure 4:
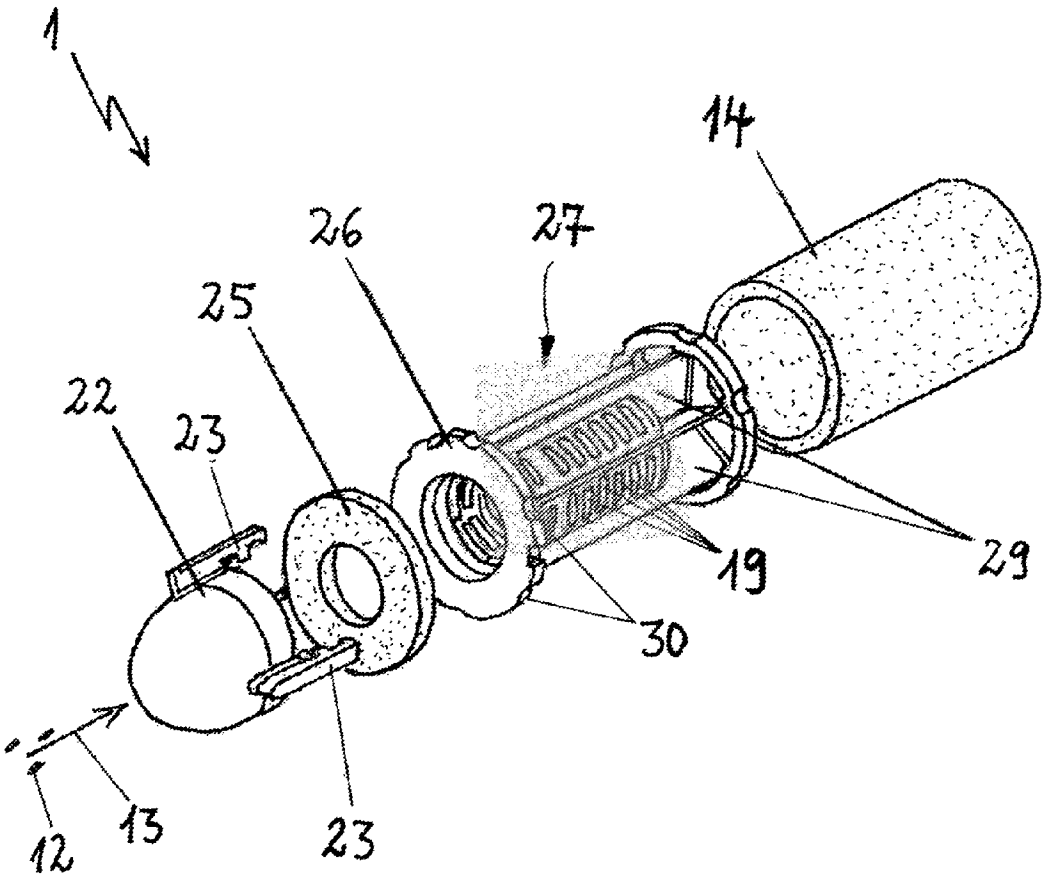
FIG. 4 is a partially-exploded perspective view of the oil separator of FIG. 3.

FIG. 4 is an exploded view of components of the oil separator 1 in accordance with the embodiment in FIG. 3, wherein the hollow member 11 is not illustrated for greater clarity. The oil separator 1 is subjected to flow with the gas flow 13 and oil 12 carried thereby from an arrow direction shown so that initially the flow guiding member 22 comes into contact with the gas flow 13 and the droplets of oil 12 shown by way of example. The flow guiding member 22 is adjoined by the oil separation ring 25 which is retained at the rear side by a carrier ring 26. In this instance, the flow guiding member 22 can be clip-fitted to the carrier ring 20 with simultaneous fixing of the oil separation ring 25, for which reason the retention ribs 23 are in the form of snap-fit hooks.

The carrier ring 26 is constructed by way of example in one piece with the intermediate element 27 and the intermediate element 27 has retention walls 29 which extend in the flow direction and by which the additional oil separation member 14 can be retained against the inner wall of the hollow member which is not shown in greater detail. Consequently, a spacing between the radial gaps 19 in the intermediate element 27 and the oil separation member 14 is maintained so that the inner side of the oil separation member 14 can be subjected to flow by the gas flow 13.

At the outer side of the carrier ring 26, there are shown recesses 30 through which oil 12 which has already been separated from the gas flow 13 by the first oil separation ring 25 can continue to be directed at the outer side of the oil separation member 14.

The nonwoven material of the oil separation member 14 does not necessarily have to touch the inner wall of the hollow member 11 but instead a gap between the outer peripheral face of the nonwoven material and the inner peripheral face of the hollow member 11 may be provided in order to promote a discharge of oil droplets.

Figure 5:
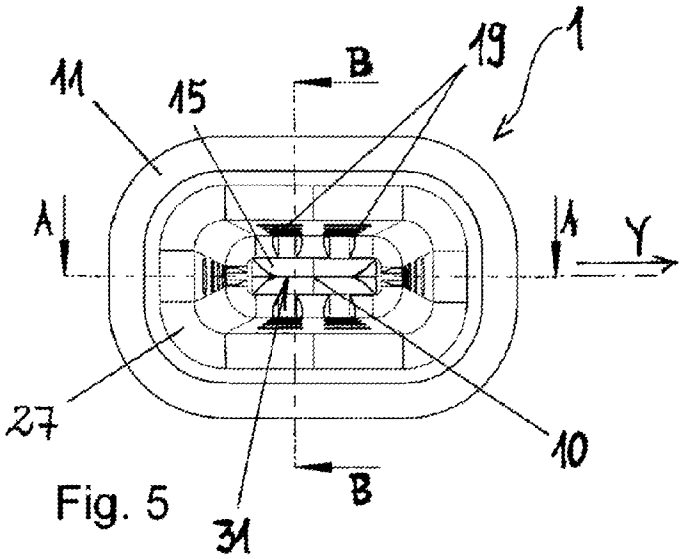
FIG. 5 is a plan view of an example oil separator that includes an example elongate extent formed in a transverse direction, but that is not constructed in a rotationally symmetrical manner.

FIG. 5 is a plan view of another embodiment of an oil separator 1 from the direction of the longitudinal axis 10, wherein the oil separator 1 is not constructed in a rotationally symmetrical manner and has an elongate and therefore planar extent which is formed in a transverse direction Y. It is possible to see in the plan view the hollow member 11 which is also planar and in which there is introduced another construction variant of an intermediate element 27, in which there are formed radial gaps 19 through which the gas flow can flow.

At the inner side in the intermediate element 27, there is formed the redirection member 15 which does not have a flow tip, as in FIG. 3, but instead the redirection member 15 has a flow edge 31 which is elongate in the transverse direction Y as a result of the elongate/planar construction.

Figure 6:
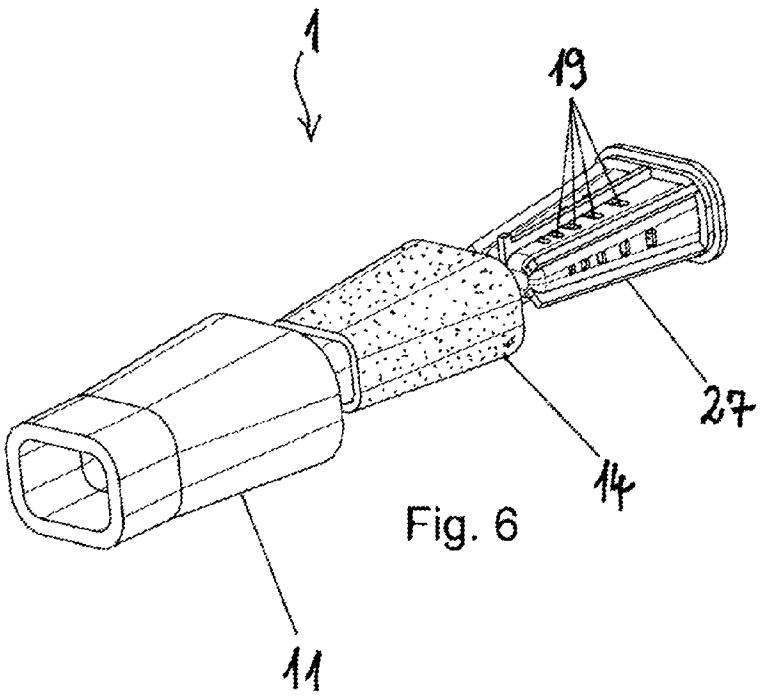
FIG. 6 is a partially-exploded perspective view of the oil separator of FIG. 5.

FIG. 6 is a partially exploded illustration of the oil separator 1 according to the embodiment from FIG. 5 with the planar hollow member 11, the planar oil separation member 14 and the intermediate element 27 in which there are formed radial gaps 19, through which the gas flow can pass and can act on the oil separation member 14 from the inner side.

Figure 8:
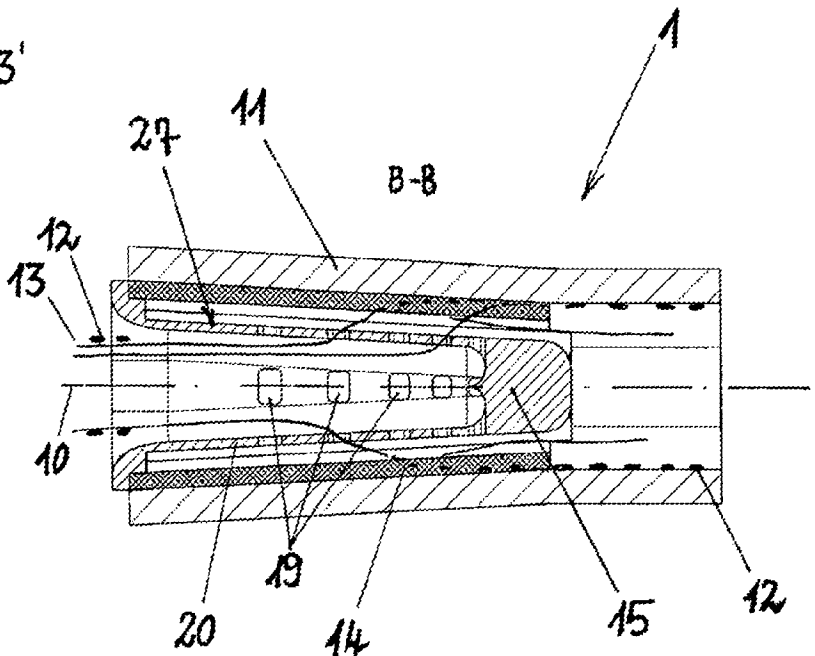
FIG. 8 is a cross-sectional view of the example oil separator taken across line B-B in FIG. 5.
Figure 7:
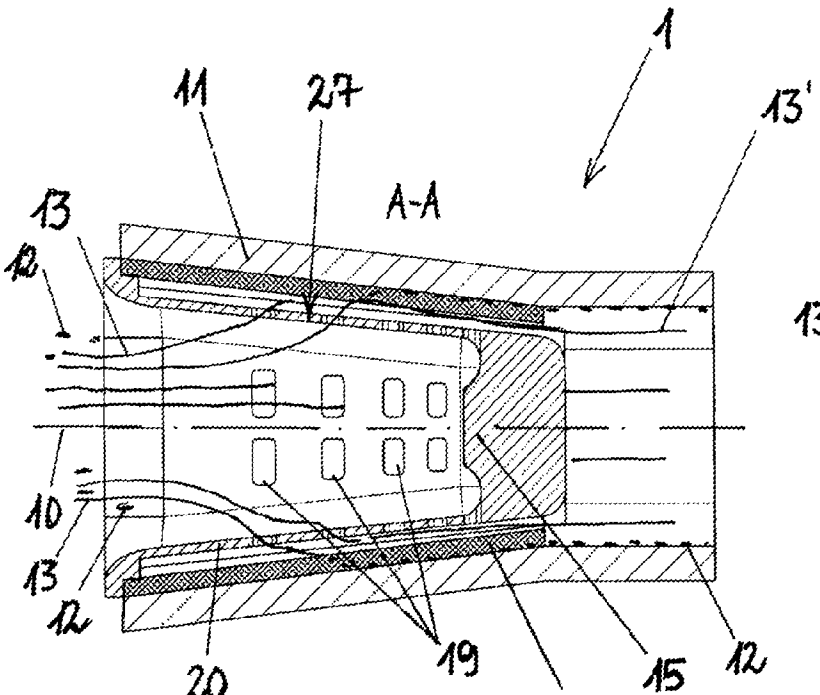
FIG. 7 is a cross-sectional view of the example oil separator taken across line A-A in FIG. 5.

FIG. 7 is a cross-section of the oil separator 1 according to the embodiment from FIG. 5 in the plane of section A-A and FIG. 8 is a cross-section of the oil separator 1 according to the embodiment from FIG. 5 in the plane of section B-B.

The embodiment of the planar oil separator 1 has a structure and a function as already described above in connection with the embodiment of FIGS. 1 and 2. At an inlet side of the hollow member 11, a gas flow 13 which is charged with oil 12 can be introduced. The gas flow 13 flows into the intermediate element 27 which is located in the oil separation member 14 and which substantially forms at the front side an inlet funnel 20, as described above in connection with FIGS. 1 and 2. There is formed in the intermediate element 27 a redirection member 15, by which the gas flow 13 is directed through radial gaps 19 to the inner side of the oil separator 14. The oil separation member 14 is constructed in a funnel-like manner and the funnel-like shape opens counter to the direction of the gas flow 13 and tapers in a downstream direction.

The oil separation member 14 is located along the longitudinal axis 10 in an axial position upstream of the redirection member 15 so that the redirection member 15 is located downstream of the oil separation member 14 and the gas flow 13, upstream of the redirection member 15, is directed thereby through the radial gaps 19 at or through the oil separation member 14. The separation of the oil 12 is carried out for a weak and for a powerful flow of the gas flow 13 as already described in connection with FIGS. 1 and 2.

The views of FIG. 7 and FIG. 8 show that the radial redirection of the gas flow 13 charged with oil 12 is also brought about without torsion in a redirection member 15 which is not rotationally symmetrical in the same manner as in a rotationally symmetrical redirection member 15 because the gas flow 13 is not subjected to any torsion when flowing through the oil separator 1. The planar construction of the oil separator 1 with an extent in a transverse direction Y can be adapted, for example, to an installation situation of the device. As a result of the gas flow 13 with the oil 12 striking the oil separation member 14, the oil 12 is separated from the gas flow 13 either by an impactor effect in the event of an impact and rebound or by a filter effect during flow through the oil separation member 14.

Figure 9:
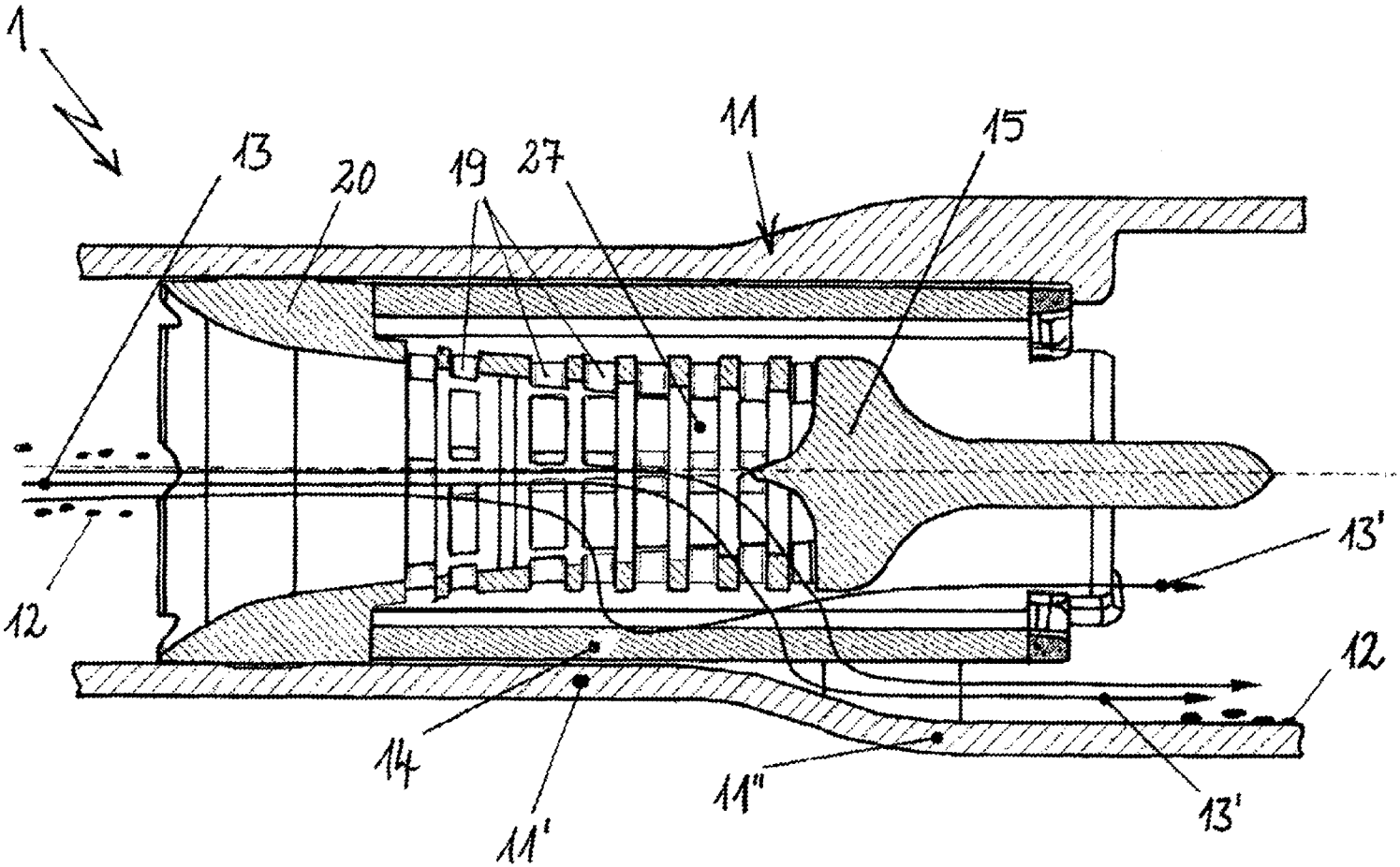
FIG. 9 is a cross-sectional view of an example oil separator having a redirection member that is arranged on an intermediate element, with an example hollow member having an expansion in a receiving portion of the oil separation member.

Finally, FIG. 9 shows a modified embodiment having an oil separator 1 which is constructed from a separately constructed inlet funnel 20, in which the gas flow 13 charged with oil 12 flows and which an intermediate element 27 integrally adjoins. The intermediate element 27 is constructed in a basket-like manner and has radial gaps 19 through which the gas flow 13 flows and flows against the inner side of the oil separation member 14. In a manner dependent on the flow speed, the gas flow 13 can then only strike the inner surface of the oil separation member 14 or travel through it until the gas flow 13' which is purged of the oil 12 again leaves the oil separator 1.

In order to redirect the gas flow 13, there is formed at the inner side in the intermediate element 27 a redirection member 15 which is flowed against by the gas flow 13 from the direction of the longitudinal axis 10 and by which the gas flow 13 is redirected radially outward in order to flow through the radial gaps 19.

The tubular oil separation member 14 is constructed from a nonwoven material and is located with a substantially constant outer diameter in a portion 11' of the hollow member 11 which has a smaller diameter so that no or only a very small radially extending gap is present between the oil separation member 14 and the inner side of the hollow member 11. As a result, the inner side of the hollow member 11 forms an impact face for a gas flow 13 which travels through the oil separation member 14 and for oil 12 present therein.

In a downstream direction, the hollow member 11 is constructed to have a portion 11" with a greater diameter or with at least one lateral expansion so that the inner side of the hollow member 11 does not abut the outer side of the oil separation member 14 and does not form an impact face, whereby in this partial region a throughflow of the oil separation member 14 with the gas flow 13 can be improved.

The construction of the invention is not limited to the preferred embodiment set out above. Instead, a number of variants which also make use of the solution set out in embodiments which are of different types in principle are conceivable. All the features and/or advantages which arise from the claims, the description or the drawings, including structural details or spatial arrangements, may be inventively significant both per se and in extremely varied combinations.

What is claimed is:

1. An oil separator for crankcase ventilation of an internal combustion engine, the oil separator comprising:

a hollow member for receiving a gas flow charged with oil, the hollow member extending axially along a longitudinal axis;

an oil separation member disposed in the hollow member in a path of the gas flow such that gas purged of oil flows through an axial passage of the oil separation member and such that separated oil is discharged between an outer side of the oil separation member and an inner wall of the hollow member; and a redirection member disposed in the hollow member and that redirects at least a portion of the gas flow traveling substantially along the longitudinal axis radially outwards against an inner side of the oil separation member.

2. The oil separator of claim 1 wherein the redirection member and the oil separation member are rotationally symmetrical with respect to the longitudinal axis, with the redirection member comprising a flow tip positioned in the longitudinal axis and a redirection contour that expands radially outwards in a hyperbola-like manner in a downstream direction.

3. The oil separator of claim 1 wherein the oil separation member has an elongated funnel shape extending along the longitudinal axis, wherein the elongated funnel shape narrows in a downstream direction.

4. The oil separator of claim 3 further comprising:

a disc-like oil separation ring disposed upstream of the oil separation member; and a flow guiding member disposed upstream of the disc-like oil separation ring, wherein the flow guiding member comprises a flow contour that increases radially outwards in the downstream direction.

5. The oil separator of claim 1 further comprising a retention member for receiving the redirection member proximate the oil separation member, wherein the retention member comprises radial gaps through which the gas flow is redirected.

6. The oil separator of claim 1 further comprising an inlet funnel disposed in the hollow member upstream of the oil separation member, wherein the inlet funnel accelerates the gas flow into the axial passage of the oil separation member.

7. The oil separator of claim 1 further comprising an opening funnel forming a diffuser disposed in the hollow member downstream of the oil separation member.

8. The oil separator of claim 7 further comprising a radially extending gap disposed between an outer side of the opening funnel and an inner side of the hollow member, wherein oil separated from the gas flow passes through the radially extending gap.

9. The oil separator of claim 1 wherein the oil separation member comprises a nonwoven material.

10. The oil separator of claim 9 wherein the oil separation member and the nonwoven material have a gas-permeability that permits the gas flow to flow partially through the oil separation member.

11. The oil separator of claim 1 wherein the hollow member is either formed from at least a portion of a camshaft of the internal combustion engine or configured to be an integral component of a cylinder head cover of the internal combustion engine.

12. The oil separator of claim 1 wherein along a first portion of the hollow member the inner wall side of the hollow member abuts the outer side of the oil separation member to form an impact face for the gas flow, wherein a second portion of the hollow member includes enlarged radial spacing relative to the first portion such that the inner wall of the hollow member is spaced apart from the outer side of the oil separation member so that a throughflow of the oil separation member with the gas flow is substantially not influenced by the hollow member.

13. The oil separator of claim 1 wherein a radial gap separates the outer side of the oil separation member and the inner wall of the hollow member, wherein the separated oil is discharged into the radial gap between the outer side of the oil separation member and the inner wall of the hollow member.

14. The oil separator of claim 5 wherein fan-like plates separate the radial gaps and redirect the gas flow upstream of the redirection member towards the inner side of the oil separation member.

15. An oil separator for crankcase ventilation of an internal combustion engine, the oil separator comprising:

a hollow member for receiving a gas flow charged with oil, the hollow member extending axially along a longitudinal axis;

an oil separation member disposed in the hollow member in a path of the gas flow, the oil separation member having an axial passage;

a redirection member disposed in the hollow member, the redirection member for redirecting at least a portion of the gas flow traveling substantially along the longitudinal axis radially outwards against an inner side of the oil separation member; and an opening funnel forming a diffuser disposed in the hollow member downstream of the oil separation member, wherein a radially extending gap exists between an outer side of the opening funnel and an inner side of the hollow member such that oil separated from the gas flow passes through the radially extending gap.

* * * * *